US007268284B2

(12) United States Patent
Lee

(10) Patent No.: US 7,268,284 B2
(45) Date of Patent: Sep. 11, 2007

(54) SWITCHABLE FOOT PEDAL SYSTEM

(76) Inventor: Jimmie Harrison Lee, P.O.B. 54562, Jacksonville, FL (US) 32245

( * ) Notice: Subject to any disclaimer, the term of this patent is extended or adjusted under 35 U.S.C. 154(b) by 175 days.

(21) Appl. No.: 11/051,715

(22) Filed: Feb. 4, 2005

(65) Prior Publication Data

US 2005/0172784 A1 Aug. 11, 2005

Related U.S. Application Data

(60) Provisional application No. 60/542,517, filed on Feb. 6, 2004.

(51) Int. Cl.
*G10D 13/02* (2006.01)

(52) U.S. Cl. ..... 84/422.2; 84/327

(58) Field of Classification Search ..... 84/422.2, 84/422.1, 42, 411 R, 327
See application file for complete search history.

(56) References Cited

U.S. PATENT DOCUMENTS 2,845,830 A * 8/1958 Haviland ..... 84/422.1
6,225,543 B1 5/2001 Miguel
6,307,136 B1 * 10/2001 Sikra et al. ..... 84/422.1
6,476,300 B1 * 11/2002 Kurosaki ..... 84/327

* cited by examiner

*Primary Examiner*—Lincoln Donovan
*Assistant Examiner*—Jianchun Qin
(74) *Attorney, Agent, or Firm*—Laurence A. Greenberg; Werner H. Stemer; Ralph E. Locher

(57) ABSTRACT

A switchable foot pedal system for a drum-playing equipment has a hi-hat to be activated by a first pedal and a base drum to be activated by a second pedal. The system includes a switch device connectable to the first pedal. The switch device is connected to the hi-hat directly and connected to the base drum through an interconnection rod with variable length. The system also has a switch selection pedal configuration provided on the first pedal. The switch selection pedal configuration switches the switch device between a position activating the hi-hat and a position activating the base drum.

10 Claims, 8 Drawing Sheets

SWITCHABLE FOOT PEDAL SYSTEM

CROSS-REFERENCE TO RELATED APPLICATION

This application claims the benefit, under 35 U.S.C. § 119(e), of U.S. provisional application No. 60/542,517, filed Feb. 6, 2004.

BACKGROUND OF THE INVENTION

FIELD OF THE INVENTION:

The invention lies in the field of musical instrument equipments, especially drum-playing equipments. The invention relates to an improvement to the existing drum-playing equipments, which enables the performers to implement playing techniques that was impossible before. More specifically, the invention relates to a switchable pedal system, which enables the drummers to switch the foot pedal freely between connecting to the hi-hat and connecting to the base drum.

Existing drum-playing equipments, including diversely sized drums, hi hats, and pedals to be operated manually, have not changed much within the last decades. The major changes that some of the equipments went through were related to the application of electronic parts and instruments and the main changes were made in the field of signal processing equipments. However, those changes do not provide the drummers with flexibility with the foot pedal control.

U.S. Pat. No. 6,225,543 B1 to Miguel describes a device with pedal for at least two percussion instruments. A cylindrical tip on end of the pedal cooperates with stirrups to enable the user to actuate alternately mobile parts of two percussion instruments. However, the device of Miguel has the disadvantages that it is noisy during operation and the pedal cannot be moved smoothly. Further, since the distance for the foot to move the pedal from the position to activate one instrument to the position to activate the other instrument is large, it is tedious for the drummer. In addition, since the pedal according to Miguel can only pivot about an axis at the heel end, it is difficult to control the accuracy and speed of the movement.

SUMMARY OF THE INVENTION

It is accordingly an object of the invention to provide an improved mechanical device which drastically changes the capabilities of the artist performers and which overcomes the disadvantages of the prior art. It allows the drummers to present fast sequences of drum excitement and setting accents, which are not possible without the device of the present invention. It is not exaggerated to say that this device will revolutionize the art of playing drums. It will soon be common equipment for each drummer just like the drum itself.

With the foregoing and other objects in view, there is provided, in accordance with the invention, a switchable foot pedal system for a drum-playing equipment having a first instrument to be activated by a first pedal and a second instrument to be activated by a second pedal, comprising: a switch device connected to the first instrument and the second instrument; and a switch selection pedal configuration provided on at least one of the first pedal and the second pedal, the switch selection pedal configuration switching the switch device between a position activating the first instrument and a position activating the second instrument.

In accordance with another feature of the invention, the first instrument is a base drum and the second instrument is a hi-hat.

In accordance with a further feature of the invention, there is provided an interconnection rod for connecting the switch device to one of the instruments located remotely from the instrument directly connected the switch device. The interconnection rod has a variable length.

In accordance with an added feature of the invention, the switch device is a switch block with a housing and two sliders in the housing, the two sliders connecting the switch selection pedal configuration to the first instrument and the second instrument, respectively.

In accordance with an additional feature of the invention, the switch selection pedal configuration has a pin or tong to engage with said two sliders, respectively, for activating the first instrument and the second instrument, respectively.

In accordance with yet another feature of the invention, the switch block is a round switch block.

In accordance with yet a further feature of the invention, the switch block is a rectangular switch block.

In accordance with yet an added feature of the invention, the switch device is a clutch device with two clutches, the switch selection pedal configuration engages with the two clutches, respectively, for activating the first instrument and the second instrument, respectively.

In accordance with yet an additional feature of the invention, the two clutches are integrated back-to-back through a linking device.

In accordance with again another feature of the invention, the clutch device includes a clutch control axle and a clutch housing for each of the two clutches, the clutch control axle is firmly connected to the clutch housing.

In accordance with again a further feature of the invention, the switch selection pedal configuration operates the clutch control axle via an eccenter.

In accordance with again an added feature of the invention, the switch selection pedal configuration includes a foot pedal, a pedal base frame, a rotational attachment connecting the foot pedal to the pedal base frame for allowing the rotation and switching action of the foot pedal, and a shoe restraint disposed on the foot pedal for precise switching.

In accordance with again an additional feature of the invention, the rotational attachment has a thrust bearing for facilitating the rotation of the switch selection pedal configuration.

In accordance with still another feature of the invention, the switch selection pedal configuration includes a pedal base frame, a foot pedal attached to the pedal base frame, a switch rod attached to an underside of the foot pedal, and a shoe restraint attached to the switch rod, the switch rod having a front end for connecting to the switch device and a back end pivotably attached to the foot pedal, the shoe restraint moving the front end of the switch rod about an axis at the back end of the switch rod.

In accordance with still a further feature of the invention, the switch selection pedal configuration includes a pedal base frame, a foot plate riding on gliders above the pedal base frame, and a foot pedal attached to the foot plate, the foot plate being pivotable about an axis perpendicular to the foot plate.

With the foregoing and other objects in view, there is also provided, in accordance with the invention, a switchable foot pedal system for a drum-playing equipment having a hi-hat to be activated by a first pedal and a base drum to be activated by a second pedal, comprising: a switch device connectable to the first pedal, the switch device being connected to the hi-hat directly and connected to the base drum through an interconnection rod with variable length; and a switch selection pedal configuration provided on the first pedal, the switch selection pedal configuration switching the switch device between a position activating the hi-hat and a position activating the base drum.

Other features that are considered as characteristic for the invention are set forth in the appended claims.

Although the invention is illustrated and described herein as embodied in a swing ladder, it is, nevertheless, not intended to be limited to the details shown because various modifications and structural changes may be made therein without departing from the spirit of the invention and within the scope and range of equivalents of the claims.

Additional advantages of the invention will be set forth in part in the description which follows, and in part will be clear from the description, or may be learned by practice of the invention. The advantages of the invention will be realized and attained by the elements and combinations particularly pointed out in the appended claims. It is to be understood that both the foregoing general description and the following detailed description are exemplary and explanatory only and are not restrictive of the invention, as claimed.

DETAILED DESCRIPTION OF PREFERRED EMBODIMENTS

The invention may be understood more readily by reference to the following detailed description of preferred embodiments of the invention.

Before the invention is disclosed and described, it is to be understood that the terminology used herein is for the purpose of describing particular embodiments only and is not intended to be limiting. It must be noted that, as used in the specification and the appended claims, the singular forms "a," "an" and "the" include plural referents unless the context clearly dictates otherwise.

The invention will now be described in detail with reference to the accompanying drawings.

Figure 1:
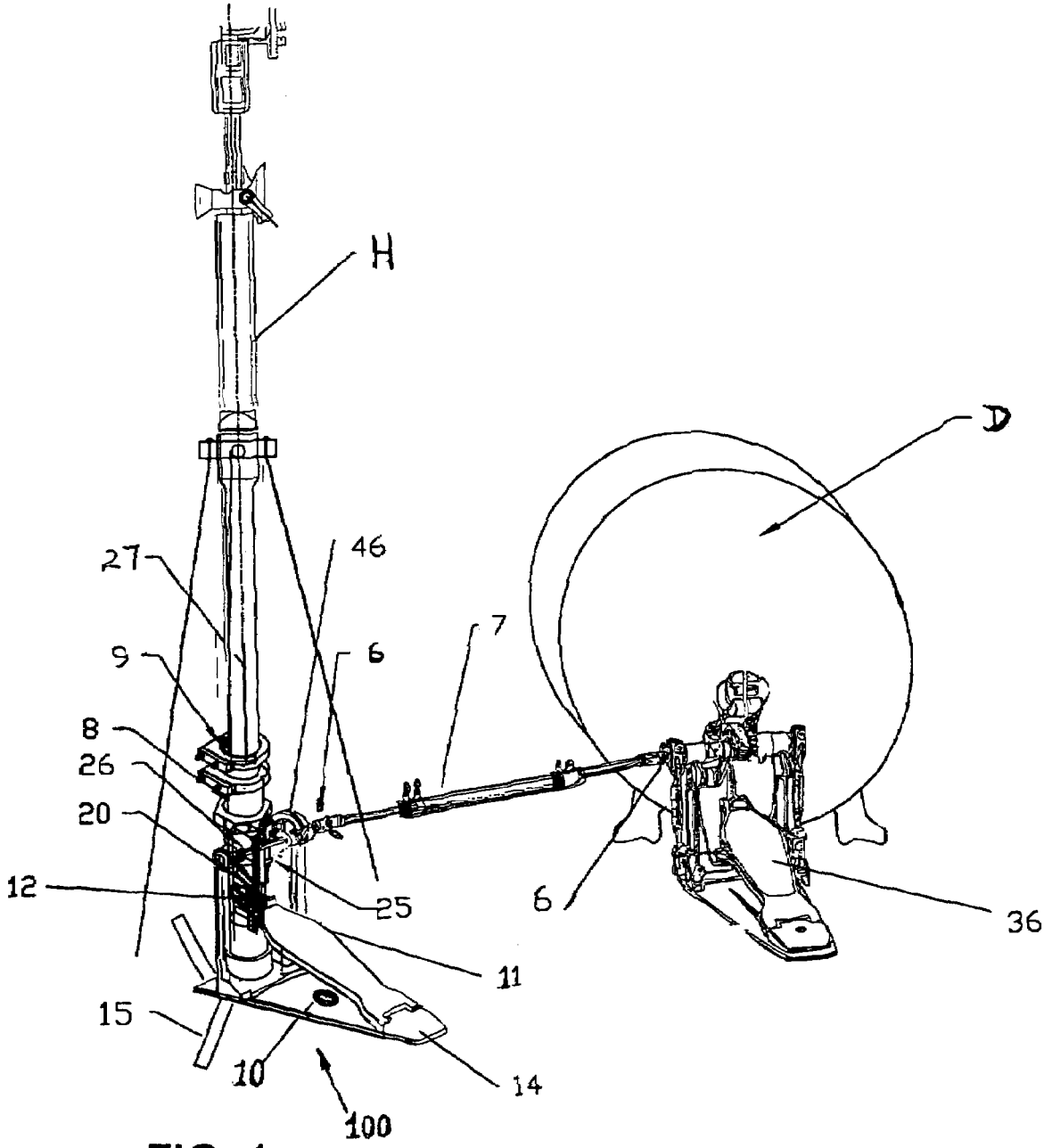
FIG. 1 is a perspective view of a drum-playing equipment with the switchable foot pedal system according to the invention.

Referring now to the figures of the drawings in detail and first, particularly to FIG. 1 thereof, there is shown a drum-playing equipment, which is usually set up in a way that the drummer operates the base drum D with his or her right foot using the right pedal 36 and operates the hi-hat H with his or her left foot using the left pedal 11. In some set-ups, the drummer is provided with two pedals for his or her left foot: one dedicated to the hi-hat operations and the other dedicated to the operations of the base drum. An interconnection rod 7 with variable length connected between two universal joints 6 is thus provided for connecting the left pedal to the base drum.

This invention allows the drummer to use only one left pedal to play the base drum D and the hi-hat H with his or her left foot. The drummer can select the instrument by slightly rotating his or her left foot in the direction of the instrument he or she wants to play. In addition, the drummer may also play the base drum and the hi-hat simultaneously with his or her left foot and additionally with his or her right foot. It is easy to understand that this by itself gives the drummer the possibilities of playing totally new sequences he or she could never perform before.

The switch selection can be done in many ways. Shown here is the preferred embodiment of turning the toe part of the drummer's left foot into the direction of the instrument he or she wants to play. A switchable pedal system 100 is provided such that by turning the drummer's foot to the right will connect the left pedal 11 via the variable length interconnection rod 7 to the base drum D. The switchable pedal system 100 of the invention consists of a switch device and a switch selection pedal configuration. The switch device may be a switch block (FIGS. 2 and 3) or a clutch device (FIG. 4). The switch selection pedal configuration is shown with three embodiments in FIGS. 5-7. Each of the embodiments of the switch device may combine with each of the embodiments of the switch selection pedal configuration, resulting in six possible combinations. In addition, the switch box may have different shapes: for example, a square or rectangular switch box as shown in FIG. 2 and a round switch box as shown in FIG. 3.

As shown in FIG. 1, the switchable pedal system 100 includes a drum steering interface 25 and a hi-hat steering interface 26. The drum steering interface 25 is connected to the interconnection rod 7 via a universal joint 6. The hi-hat steering interface 26 is connected to the hi-hat H via a hi-hat activation cable 27 within a hi-hat adaptor 8 and a hi-hat clamp 9. A switch device 20 is provided for switching the left pedal 11 from the hi-hat steering interface 26 to the drum steering interface 25 or vice versa. The left pedal 11 has a tong or pin 12 for linking into the sliders of the switch device 20 (see FIGS. 3-4 for details).

Figure 2:
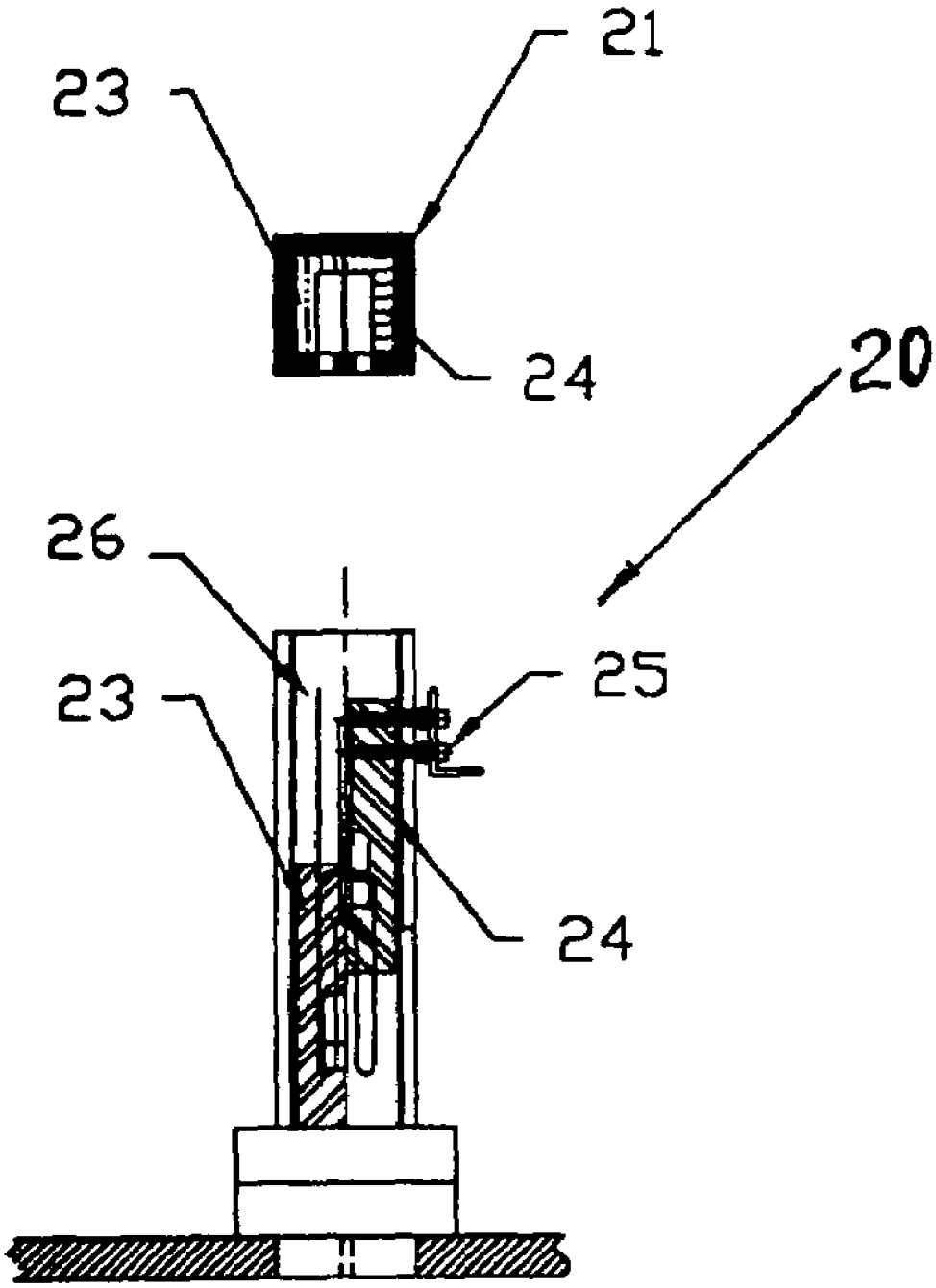
FIG. 2 is a diagrammatical top and side view of a rectangular switch block with sliders therein.

FIG. 2 shows one embodiment of the switch device with a square or rectangular switch block 20. As can be seen in FIG. 2, the switch block 20 includes a square or rectangular tube 21 which houses two sliders—a left slider 23 and a right slider 24. Each of the sliders can be moved in a vertical direction by the tong or pin 12 of the pedal 11. FIG. 2 shows the operation of the hi-hat in which the left slider 23 is pushed down. The left slider 23 is connected to the hi-hat steering interface 26 and the right slider 24 is connected to the drum steering interface 25.

Figure 3:
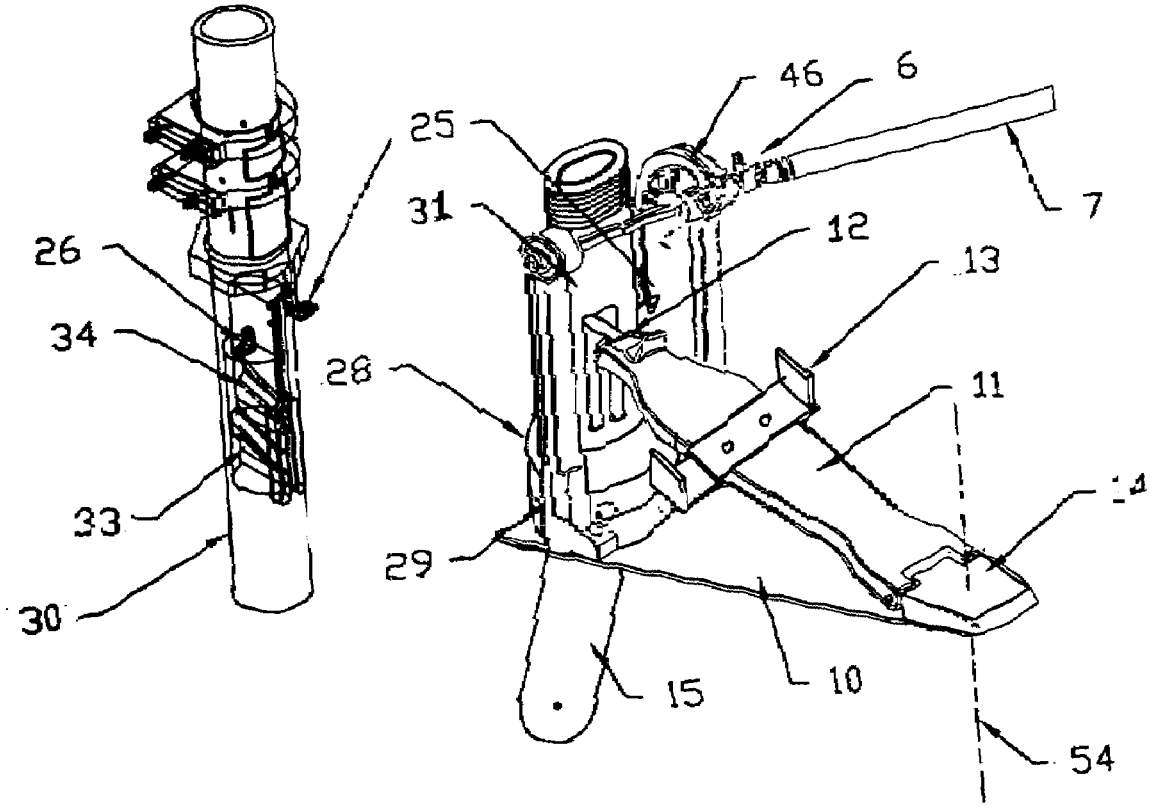
FIG. 3 is a fragmentary perspective view of a configuration of the switchable foot pedal system with a round switch block.
Figure 4:
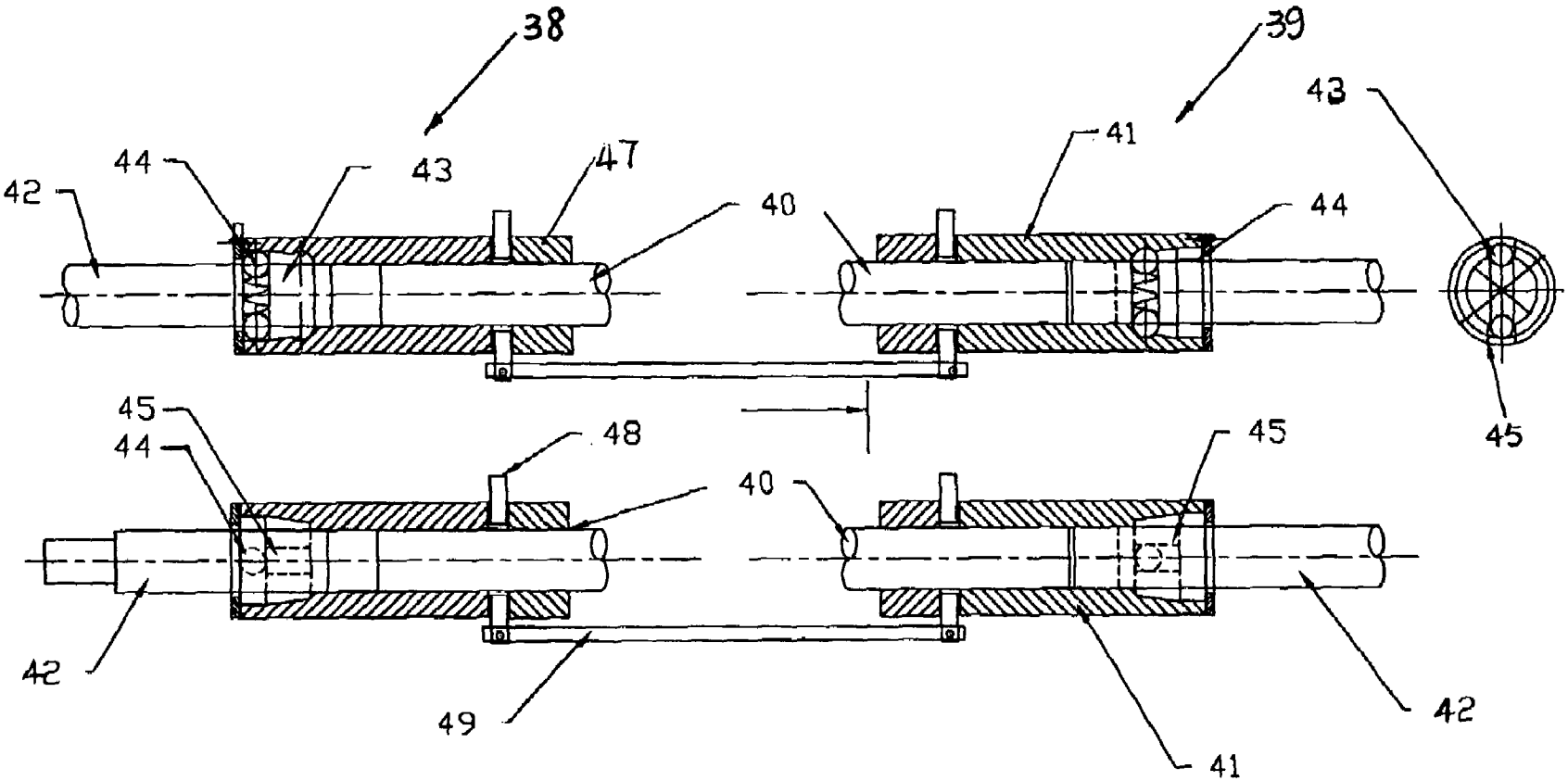
FIG. 4 diagrammatically shows a clutch device including two back-to-back integrated clutches.

FIG. 3 shows a similar switch block as FIG. 2. In FIG. 3, the switch block 30 has a round tube 31, which houses two sliders: a left slider 33 and a right slider 34. Each of the sliders can be moved in a vertical direction by the tong or pin 12 of the pedal 11. As can be seen in FIG. 3, the switch block is attached to the pedal base frame 10 via a damper ring 28 and an attachment ring 29 with inner threads. The damper ring 28 is made of rubber for damping the pedal movement on its pushed down position for avoiding any sound when the pedal reaches its lower stop. The pedal base frame 10 has stabilizer feet 15 and a rotational attachment 14 connected to the pedal 11. The rotational attachment 14 allows the rotation of the pedal 11 around the axis 54 and thus the switching action. The left pedal 11 has a shoe restraint 13 attached thereto for restraining the movement of the foot and thus giving the artist a precisely controlled movement capability to move the tong or pin 12 into the slot of the left slider 33 or the right slider 34 of the switch block 30. The switch block 30 is connected to an eccenter 46, which in turn is connected to the interconnection rod 7 via a universal joint 6.

A further possibility for the configuration of the switch block (not shown in the figures) is two separated switch blocks—either round or rectangular—one for the hi-hat and one for the base drum operations.

FIG. 4 shows a clutch device including two back-to-back integrated clutches 38, 39. The engagement is carried out by ball bearing balls 44 moving into a catch grove 45 when the housing 41 is moved horizontally by a slight turn of the left pedal 11, which moves the axle 40 that firmly connected to the housing 41. In this figure, the clutch 38 for activating the hi-hat H is shown disengaged whereas the clutch 39 for the drum operation is engaged. In this figure, the drummer has shifted his or her left foot to the right, which causes the connecting links 48 and 49 to move to their rightmost position. The adjustment ring 47 shown here, which is firmly attached to the axle 40, is a typical attachment for attaching the links to the housing 41. This clutch device has the advantages that it is free of any servicing, it provides noiseless, quite operation, and can be set up that the drummer is able to operate the hi-hat and the drum simultaneously which causes the hi-hat to make sound at the beat of the drum. The device steering axle 42 is used to be connected to the base drum D or the hi-hat H.

Figure 5:
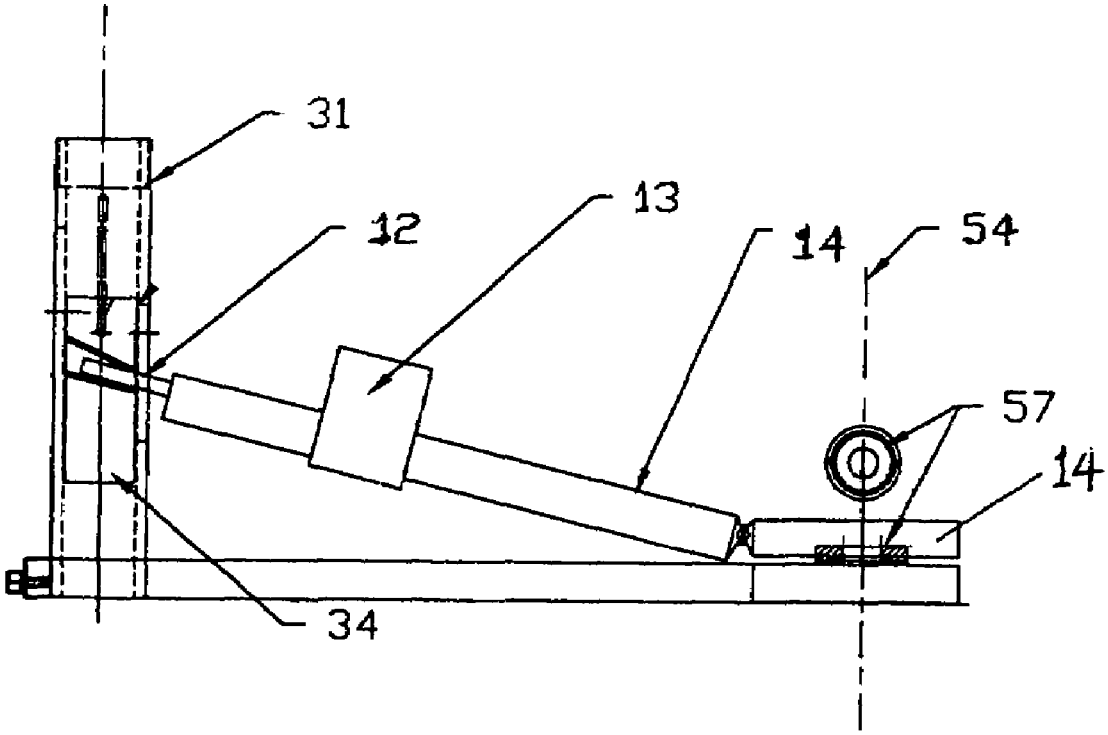
FIG. 5 diagrammatically shows a first embodiment of the switch selection pedal configuration.

FIG. 5 shows a first embodiment of the switch selection pedal configuration. The drummer can rotate the pedal 11 around the axis 54, which is located in the center of the rotational attachment 14. A thrust bearing 57 makes the alternate small rotations of the pedal reliable and noiseless. Moving the front part of the foot to the right will cause an engagement of the switching mechanism for the operations of the base drum and disengage the hi-hat operations. The turning of the foot is transferred to the pedal via the foot restraint 13.

Figure 6:
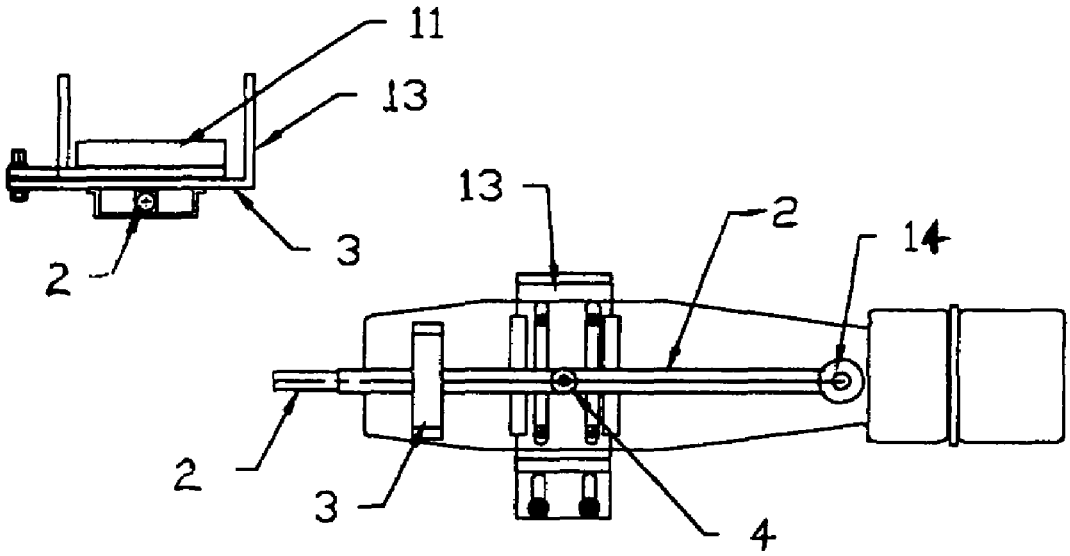
FIG. 6 diagrammatically shows a second embodiment of the switch selection pedal configuration.
Figure 6:
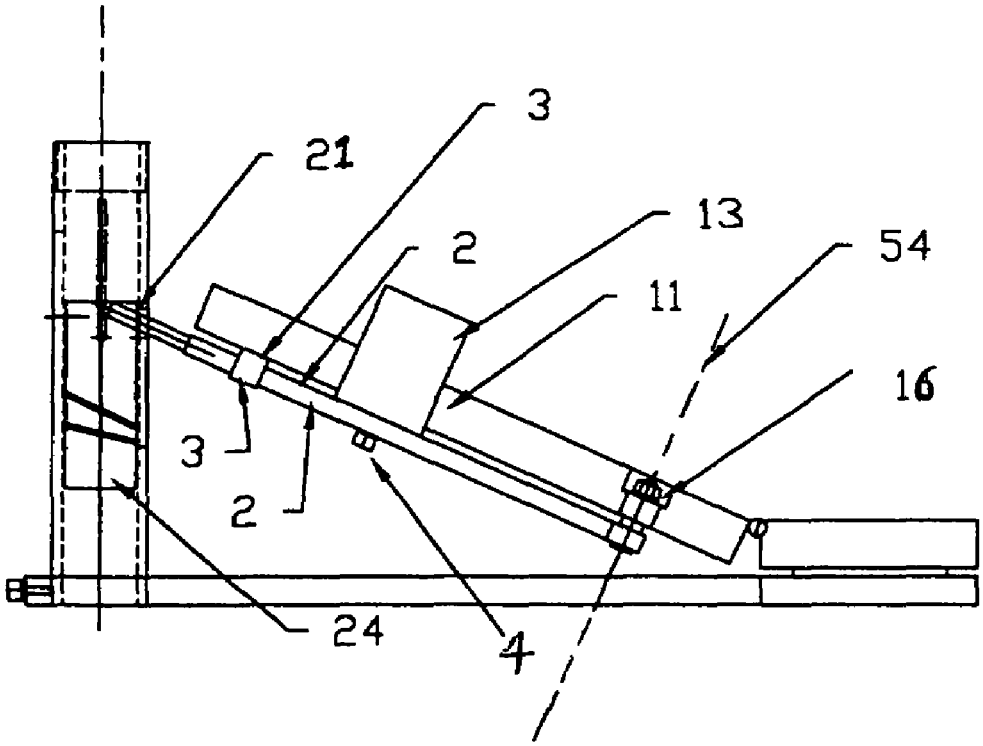

FIG. 6 shows a second embodiment of the switch selection pedal configuration. A switch or shift rod 2 is fastened to the underside of the pedal 11 at two points: the point 16 around which the rod 2 can rotate and the rotation free point 4 on the foot restraint 13. The foot restraint 13 can be shifted left or right by the drummer. These small movements cause the rod front end 2' to select the left or right slider of the switch block or the switch frame 56 of the clutch device (see FIG. 8). Reference numeral 3 shows a clamp used to hold the shift rod 2 attached to the pedal 11. It is noted that in this embodiment the pedal 11 itself does not pivot from left to right or from right to left.

Figure 7:
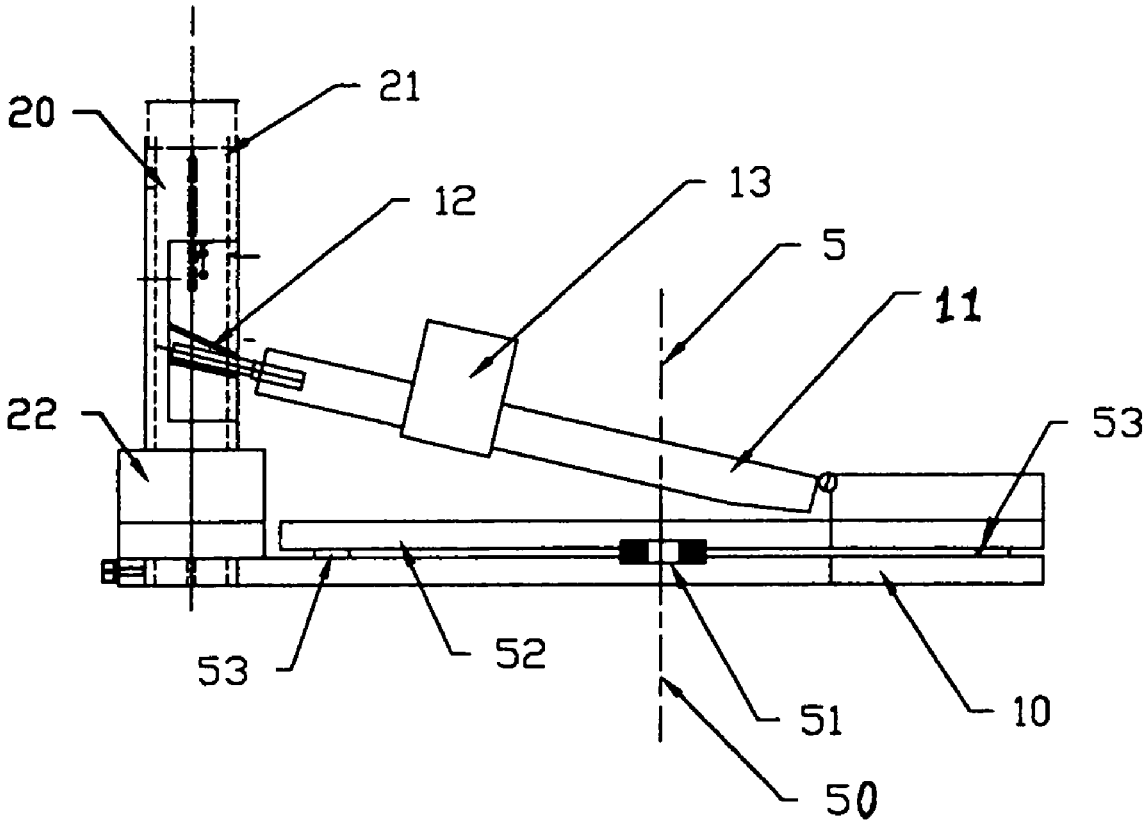
FIG. 7 diagrammatically shows a third embodiment of the switch selection pedal configuration.

FIG. 7 shows a third embodiment of the switch selection pedal configuration, in which the total pedal sitting on the base frame 10 can be rotated by the movement of the drummer's foot. The total pedal 11 with its foot plate 52 can rotate around the axis 50 of the thrust bearing 51. The foot plate 52 rides on gliders 53 above the base frame 10. The thrust bearing 51 can be located anywhere on the foot plate 52, but preferably between the front part of the foot and the heel.

The table below is a comparison of the three embodiments of the switch selection pedal configuration as shown in FIGS. 5-7 and as discussed above.

| | Embodiment I (FIG. 5) | Embodiment II (FIG. 6) | Embodiment III (FIG. 7) |
|---|---|---|---|
| Complexity | Low | Medium | Very low |
| Simplicity | Medium | Low | Simple |
| Number of parts | Medium | Medium | Less than medium |
| Reliability | Lowest | Very reliable | Most reliable |
| Accuracy | Lowest | High | Highest |
| Ease of operation | Lowest | Very easy | Best |
| Noise during operations | Medium | More noisy | Quiet |
| Mfg cost | More than medium | Medium | Lowest |
| Maintenance | Highest | Maintain free | Medium |
| Technical comparison | Embodiment I uses the lower part of the pedal for the integration of the turning mechanism, which includes a small thrust bearing, distance holders (shims) and annular spring. The mechanism is squeezed into a tiny place making it unreliable and demanding more maintenance than the other two discussed concepts. As the mechanism is in a small spot, compared to the size of the pedal it is more sloppy and therefore more noisy and inaccurate. The manufacturing costs are higher as it demands the closest tolerances. | Embodiment II is a very easy system. It has no precision parts and is maintenance free, easy to handle and easy to adjust and to operate. It is, however, the noisiest system. | Embodiment III is the most balanced configuration. It combines high reliability, low number of parts, ease of manufacturing and room for a bigger thrust ring (compared to embodiment I). |

It is noted that all three embodiments have their validity and all three can be used. However, taking into consideration of the above-discussed pros and cons, the three systems would be rated from high to low as follows: first, the embodiment III; second, the embodiment II; and third, the embodiment I.

Figure 8:
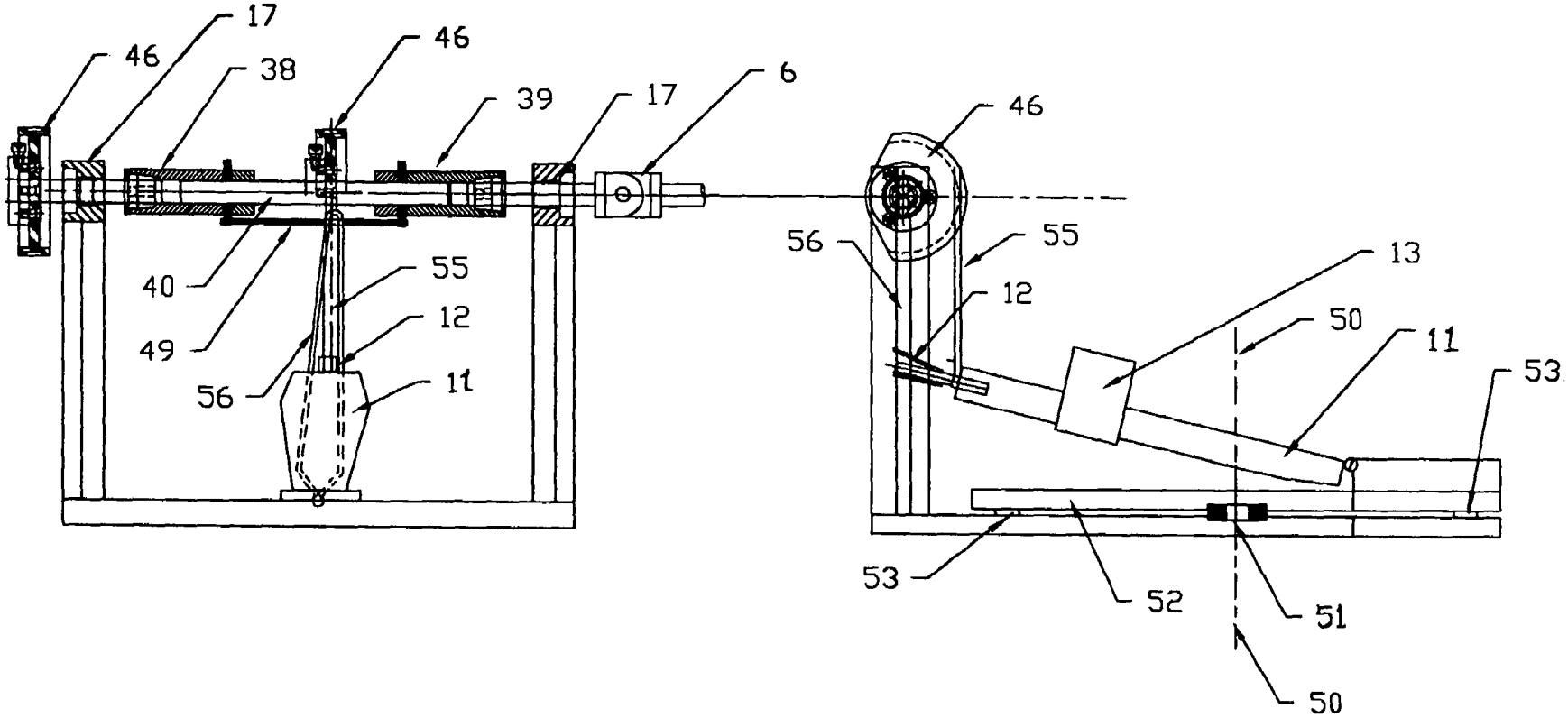
FIG. 8 diagrammatically shows an embodiment of the switchable pedal system of the invention, namely a combination of the clutch device as shown in FIG. 4 with the thirds embodiment of the switch selection pedal configuration as shown in FIG. 7.

FIG. 8 shows an embodiment of the switchable pedal system 100 of the invention, which is a combination of the clutch device as shown in FIG. 4 with the thirds embodiment of the switch selection pedal configuration as shown in FIG. 7. The rotation of the pedal 11 and the foot plate 52 causes the tong or pin 12 of the pedal 11 to tilt the shift frame 56 and move the yoke 49 to the right or left. This movement will cause the clutches to disengage or engage for switching between the hi-hat and base drum operations. Also seen in FIG. 8 is the cable 55, which is fastened to the pedal tip and connects to the eccenter 46 to cause the steering axle 42 to turn. Also shown in FIG. 8 are the ball bearing assemblies 17 for connecting the axle 40 to the pedal structure.

The configuration of the switchable pedal system as shown in the figures is for left pedal of a drum-playing equipment for a right-handed drummer. It is to be understood that the switchable pedal system also can be applied to the right pedal of a drum-playing equipment for a left-handed drummer.

Other embodiments of the invention will be apparent to those skilled in the art from consideration of the specification and practice of the invention disclosed herein. It is intended that the specification and examples be considered as exemplary only.

I claim:

1. A switchable foot pedal system for a drum-playing equipment having a first instrument to be activated by a first pedal and a second instrument to be activated by a second pedal, comprising:

a switch device connected to the first instrument and the second instrument; and a switch selection pedal configuration provided on at least one of the first pedal and the second pedal, said switch selection pedal configuration switching said switch device between a position activating the first instrument and a position activating the second instrument;

wherein said switch device is a switch block with a housing and two sliders in said housing, said two sliders connecting said switch selection pedal configuration to the first instrument and the second instrument, respectively.

2. The switchable foot pedal system according to claim 1, wherein the first instrument is a base drum and the second instrument is a hi-hat.

3. The switchable foot pedal system according to claim 1, further comprising an interconnection rod for connecting said switch device to one of the instruments located remotely from the instrument directly connected said switch device, said interconnection rod having a variable length.

4. The switchable foot pedal system according to claim 1, wherein said switch selection pedal configuration has a pin or tong to engage with said two sliders, respectively, for activating the first instrument and the second instrument, respectively.

5. The switchable foot pedal system according to claim 1, wherein said switch block is a round switch block.

6. The switchable foot pedal system according to claim 1, wherein said switch block is a rectangular switch block.

7. The switchable foot pedal system according to claim 1, wherein said switch selection pedal configuration includes a foot pedal, a pedal base frame, a rotational attachment connecting said foot pedal to said pedal base frame for allowing the rotation and switching action of said foot pedal, and a shoe restraint disposed on said foot pedal for precise switching.

8. The switchable foot pedal system according to claim 7, wherein said rotational attachment has a thrust bearing for facilitating the rotation of said switch selection pedal configuration.

9. The switchable foot pedal system according to claim 1, wherein said switch selection pedal configuration includes a pedal base frame, a foot pedal attached to said pedal base frame, a switch rod attached to an underside of said foot pedal, and a shoe restraint attached to said switch rod, said switch rod having a front end for connecting to said switch device and a back end pivotably attached to said foot pedal, said shoe restraint moving said front end of said switch rod about an axis at said back end of said switch rod.

10. The switchable foot pedal system according to claim 1, wherein said switch selection pedal configuration includes a pedal base frame, a foot plate riding on gliders above said pedal base frame, and a foot pedal attached to said foot plate, said foot plate being pivotable about an axis perpendicular to said foot plate.

* * * * *